US009133633B2

(12) United States Patent
Brown et al.

(10) Patent No.: US 9,133,633 B2
(45) Date of Patent: Sep. 15, 2015

(54) MODULAR INSULATED SCAFFOLD WALL SYSTEM

(71) Applicant: TBFL, Inc., Monrovia, CA (US)

(72) Inventors: John E. Brown, Pasadena, CA (US); Adam L. Cole, Covina, CA (US)

(73) Assignee: TBFL, Inc., Monrovia, CA (US)

( * ) Notice: Subject to any disclaimer, the term of this patent is extended or adjusted under 35 U.S.C. 154(b) by 0 days.

(21) Appl. No.: 13/910,821

(22) Filed: Jun. 5, 2013

(65) Prior Publication Data

US 2013/0318889 A1 Dec. 5, 2013

Related U.S. Application Data

(60) Provisional application No. 61/655,932, filed on Jun. 5, 2012, provisional application No. 61/789,933, filed on Mar. 15, 2013.

(51) Int. Cl.

| | |
|---|---|
| ***E04G 3/24*** | (2006.01) |
| ***E04G 5/12*** | (2006.01) |
| *E04G 7/30* | (2006.01) |

(52) U.S. Cl.

CPC .. *E04G 3/24* (2013.01); *E04G 5/12* (2013.01); *E04G 7/307* (2013.01); *Y10T 403/30* (2015.01)

(58) Field of Classification Search

CPC ..... E04G 1/00; E04G 4/08; E04G 1/15; E04G 5/00; E04G 5/001; E04G 5/002; E04G 5/08; E04G 5/12; E04G 3/24; E04G 21/28; E04G 21/24; E04H 14/00

USPC ..... 52/3, 5, 79.5, 651.1; 182/129, 152

See application file for complete search history.

(56) References Cited

U.S. PATENT DOCUMENTS

| | | | | | |
|---|---|---|---|---|---|
| 2,137,911 | A | * | 11/1938 | Innocenti | 52/459 |
| 2,798,574 | A | * | 7/1957 | Wardell | 182/129 |
| 3,121,470 | A | * | 2/1964 | Stone et al. | 182/129 |
| 3,376,676 | A | * | 4/1968 | Tatevossian | 52/93.2 |
| 3,858,364 | A | * | 1/1975 | Proulx | 52/127.1 |
| 4,637,179 | A | * | 1/1987 | Bigelow et al. | 52/79.5 |
| 4,840,513 | A | | 6/1989 | Hackett | |
| 4,907,388 | A | | 3/1990 | Siahatgar | |
| 4,967,875 | A | | 11/1990 | Beeche | |
| 5,038,889 | A | * | 8/1991 | Jankowski | 182/129 |
| 5,207,527 | A | | 5/1993 | Duncan et al. | |
| 5,263,296 | A | | 11/1993 | Spera | |

(Continued)

FOREIGN PATENT DOCUMENTS

| | | |
|---|---|---|
| EP | 0402816 B1 | 11/1994 |
| WO | WO 2010142797 A1 | 12/2010 |

*Primary Examiner* — Elizabeth A Plummer
*Assistant Examiner* — Kyle Walraed-Sullivan
(74) *Attorney, Agent, or Firm* — Sheppard, Mullin, Richter & Hampton LLP

(57) ABSTRACT

A scaffold wall system for erecting temporary insulated facilities using a scaffold structure for support is disclosed. The system comprises a floor supported by the scaffold structure, a plurality of walls supported by the floor, and a ceiling supported by the walls. The floor comprises a plurality of support beams laid across the scaffold structure, and floor boards laid across the support beams. The walls comprise a plurality of wall panels placed into customized tracks secured to the floor. Insulative sleeves are placed between the wall panels. The ceiling also comprises a plurality of panels with insulative sleeves. The system allows for multiple levels of temporary insulated facilities to be erected within a scaffold.

21 Claims, 11 Drawing Sheets

(56) References Cited

U.S. PATENT DOCUMENTS

| | | | | |
|---|---|---|---|---|
| 6,027,276 | A | 2/2000 | Schworer | |
| 6,283,251 | B1 | 9/2001 | Merkel | |
| 8,136,633 | B2 | 3/2012 | Rogers | |
| 2006/0225960 | A1* | 10/2006 | Ferlin et al. | 182/138 |
| 2007/0011955 | A1* | 1/2007 | Richard | 52/79.1 |
| 2012/0228060 | A1 | 9/2012 | Rogers | |
| 2013/0177346 | A1 | 7/2013 | Brinkmann | |

* cited by examiner

METHOD FOR CONSTRUCTING MODULAR TEMPORARY STRUCTURE

METHOD FOR CONSTRUCTING MULTI-LEVEL MODULAR TEMPORARY STRUCTURE

MODULAR INSULATED SCAFFOLD WALL SYSTEM

CROSS-REFERENCE TO RELATED APPLICATION

The present application claims priority to U.S. Provisional Application No. 61/655,932, entitled "Modular Insulated Scaffold Wall System," filed Jun. 5, 2012, the entire contents of which are herein incorporated by reference, and to U.S. Provisional Application No. 61/789,933, entitled "Modular Insulated Scaffold Wall System," filed Mar. 15, 2013, the entire contents of which are herein incorporated by reference.

BACKGROUND OF THE INVENTION

The present invention relates generally to temporary structures, and more particularly to temporary office and storage spaces built within scaffolding.

Temporary, on-site indoor facilities are often needed at outdoor work-sites. Examples of such sites might include, but are not limited to, sporting events, concerts, construction sites, political rallies, traveling shows, conventions, and the like. Indoor facilities may be needed on such sites to conduct meetings, sell merchandise, or provide a preparation area for performers or speakers. Currently, mobile office trailers are the most common solution for temporary, on-site indoor space.

While mobile office trailers do provide mobile indoor facilities, they come with several disadvantages. First, mobile trailers cannot be stacked on top of each other. As such, mobile trailers can provide only a single level of indoor facilities. It is often the case at such event or project sites that multiple indoor facilities are needed (e.g., multiple offices, gift shops, performer preparation areas, and concessions stands). It can be seen that using individual mobile trailers for each of these indoor facilities quickly takes up large areas of valuable space on a space-restricted project or event site.

Another disadvantage of mobile trailers is that they come in pre-configured sizes and layouts. Therefore, architects, event planners, and construction managers must plan around the size of the mobile trailers when planning their event or project space, rather than having indoor facilities that can be customized to the needs of the individual project or work site. Once again, on a space-restricted site, this can be a very large inconvenience.

Thus, it can readily be appreciated that there is a need for temporary, on-site indoor facilities that are more space-efficient than mobile office trailers and offer a greater range of customizability. The present invention fulfills this need and provides further related advantages.

SUMMARY OF THE INVENTION

The present invention resides in a temporary structure in which an insulated facility is built within a scaffold structure, wherein the scaffold is used to support the insulated facility. In particular, the structure can comprise a scaffold, a floor that is supported by the scaffold, a plurality of walls that are supported by the floor, and a ceiling that is supported by the walls, wherein the floor, walls, and ceiling define a substantially enclosed space that is supported by the scaffold.

In a presently preferred embodiment, by way of example, the floor comprises a plurality of support beams that are placed on the beams of the scaffold and floor boards placed on top of the support beams. The walls comprise a plurality of insulated panels that slide into wall panel tracks secured to the floor boards. The wall panels are further supported by support hooks attached to the outside wall of the panel. The support hooks are then used to mount the wall panel onto an adjacent beam of the scaffold. The walls also comprise a plurality of insulative sleeves that are placed between the wall panels. The ceiling may also comprise a plurality of panels that are secured to the walls. Insulative sleeves may also be placed between each of the ceiling panels.

Preferably, the components used to build the structure are largely modular, standard, pre-fabricated components. Components that may be pre-fabricated in standard sizes include the support beams, the floor panels, the wall panels and the ceiling panels. In a preferred embodiment, the wall panels are insulated 4'×8' panels with wood paneling on one side and a galvanized sheet metal on the other. The sides of the panels are capped with a steel channel to give the panel rigidity. The wall panels may be solid panels, window panels, door panels, or air conditioning panels. Ceiling panels may be created using similar materials to those used in the wall panels.

The present invention is also embodied in a modular temporary structure. The modular temporary structure comprises a scaffold, a plurality of support beams laid across the scaffold, a plurality of pre-fabricated floor panels of standard shapes and sizes laid on the plurality of support beams to form a floor, a plurality of wall panel tracks secured to the floor, a plurality of pre-fabricated wall panels of standard shapes and sizes inserted into the plurality of wall panel tracks to substantially enclose the floor and form a plurality of walls; and a plurality of ceiling panels laid on top of the plurality of walls to form a ceiling. The floor, the plurality of walls, and the ceiling define a substantially enclosed space that is supported by the scaffold. It is possible that the pre-fabricated components (e.g., the floor panels and wall panels) will include multiple standardized shapes and sizes. For example, pre-fabricated 4'×8' wall panels may be used to form substantially all of the walls, with 1'×8' panels being used to fill in any remaining spaces, as necessary. The support beams and ceiling panels may also be pre-fabricated in one or more standard sizes. In a preferred embodiment, the plurality of wall panels are insulated wall panels, and insulative sleeves are placed between each of the plurality of wall panels. The structure may include multiple levels of enclosed indoor facilities within the scaffold.

In yet another embodiment, the present invention resides in a method of constructing a modular temporary structure. The method comprises pre-fabricating a plurality of support beams, floor boards, and wall panels; erecting a scaffold; laying the plurality of pre-fabricated support beams across the scaffold; laying the plurality of pre-fabricated floor boards across the support beams to create a floor; securing the plurality of pre-fabricated wall panels to the floor boards to create a plurality of walls; and securing a plurality of ceiling panels to the plurality of walls to create a ceiling. The floor, the plurality of walls, and the ceiling define a substantially enclosed space that is supported by the scaffold.

The present invention also resides in a method of constructing a multi-level modular temporary structure. The method comprises pre-fabricating a plurality of support beams, floor boards, and wall panels; erecting a scaffold; and performing the following steps (a)-(d) on both a first level of the scaffold and a second level of the scaffold: (a) laying the plurality of pre-fabricated support beams across the scaffold; (b) laying the plurality of pre-fabricated floor boards across the support beams to create a floor; (c) securing the plurality of pre-fabricated wall panels to the floor boards to create a plurality of walls; and (d) securing a plurality of ceiling panels to the plurality of walls to create a ceiling, wherein the floor, the plurality of walls, and the ceiling define a substantially enclosed space, the substantially enclosed space being supported by the scaffold.

Other features and advantages of the invention should become apparent from the following description of the preferred embodiments, taken in conjunction with the accompanying drawings, which illustrate, by way of example, the principles of the invention.

BRIEF DESCRIPTION OF THE DRAWINGS

A presently preferred embodiment of the invention will now be described, by way of example only, with reference to the following drawings.

DETAILED DESCRIPTION OF THE PREFERRED EMBODIMENTS

Figure 1:
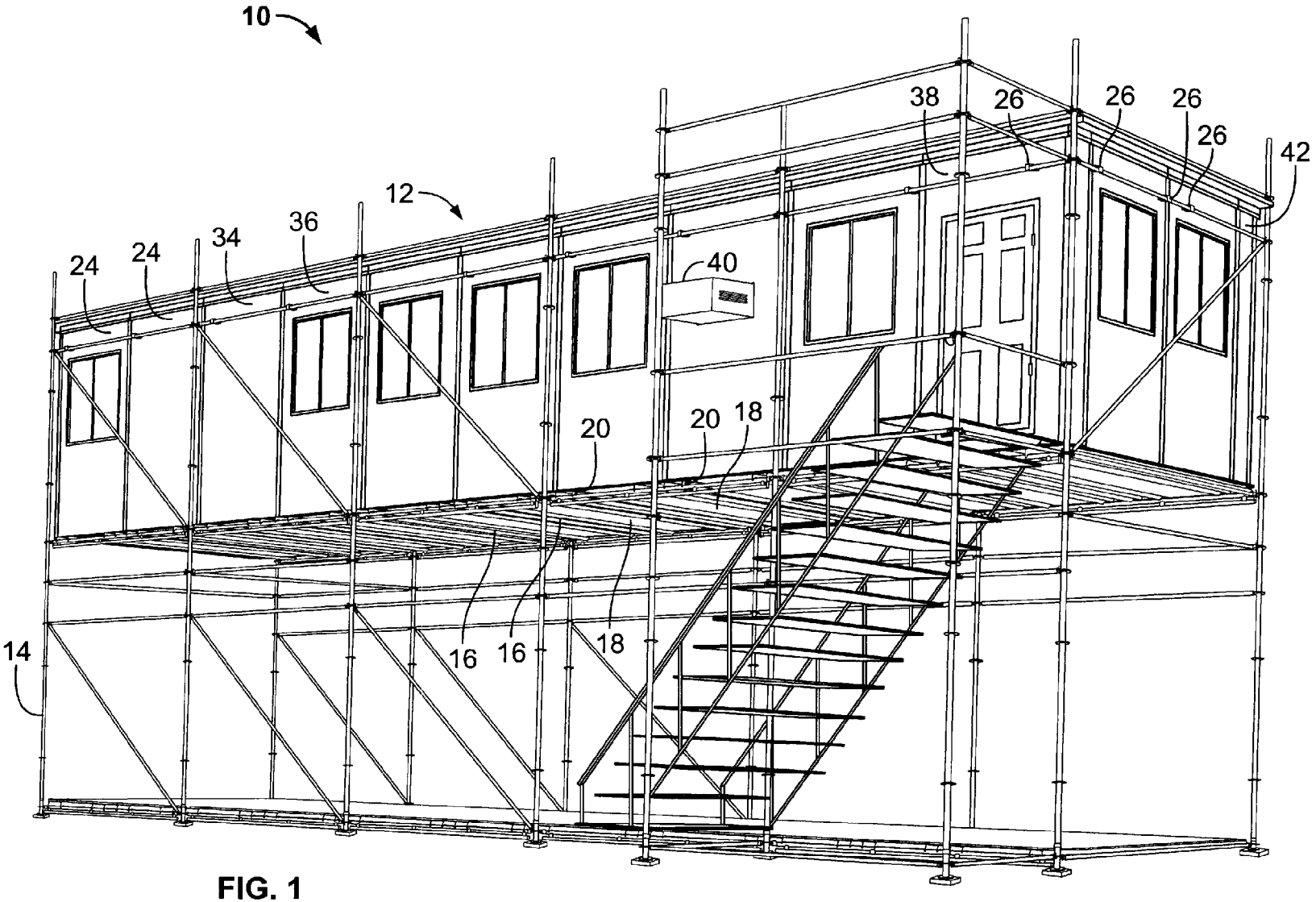
FIG. 1 is a perspective view of a modular insulated scaffold wall system, in accordance with a preferred embodiment of the invention.

Referring now to the drawings, and particularly to FIG. 1 thereof, there is shown a modular insulated scaffold wall system 10, in accordance with a presently preferred embodiment of the invention. The system 10 comprises an insulated facility 12 built within a scaffold framework 14. The scaffold 14 may be scaffolding that has been erected for spectator bleachers or some other event-related purpose, or it may be erected specifically for the purpose of supporting the present invention.

Figure 2A:
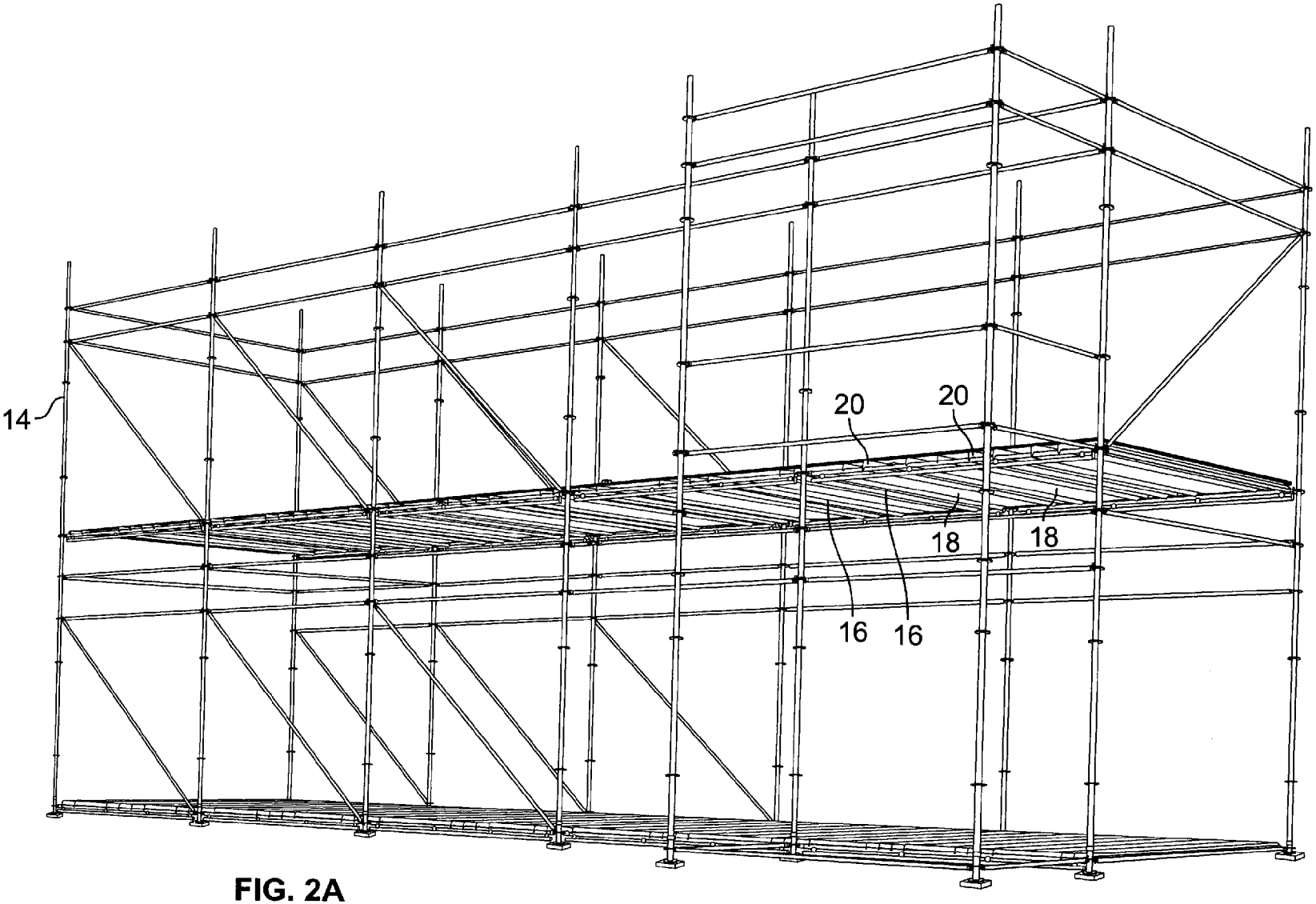
FIG. 2A is a low-angle view of the floor of the modular scaffold wall system of FIG. 1.
Figure 2B:
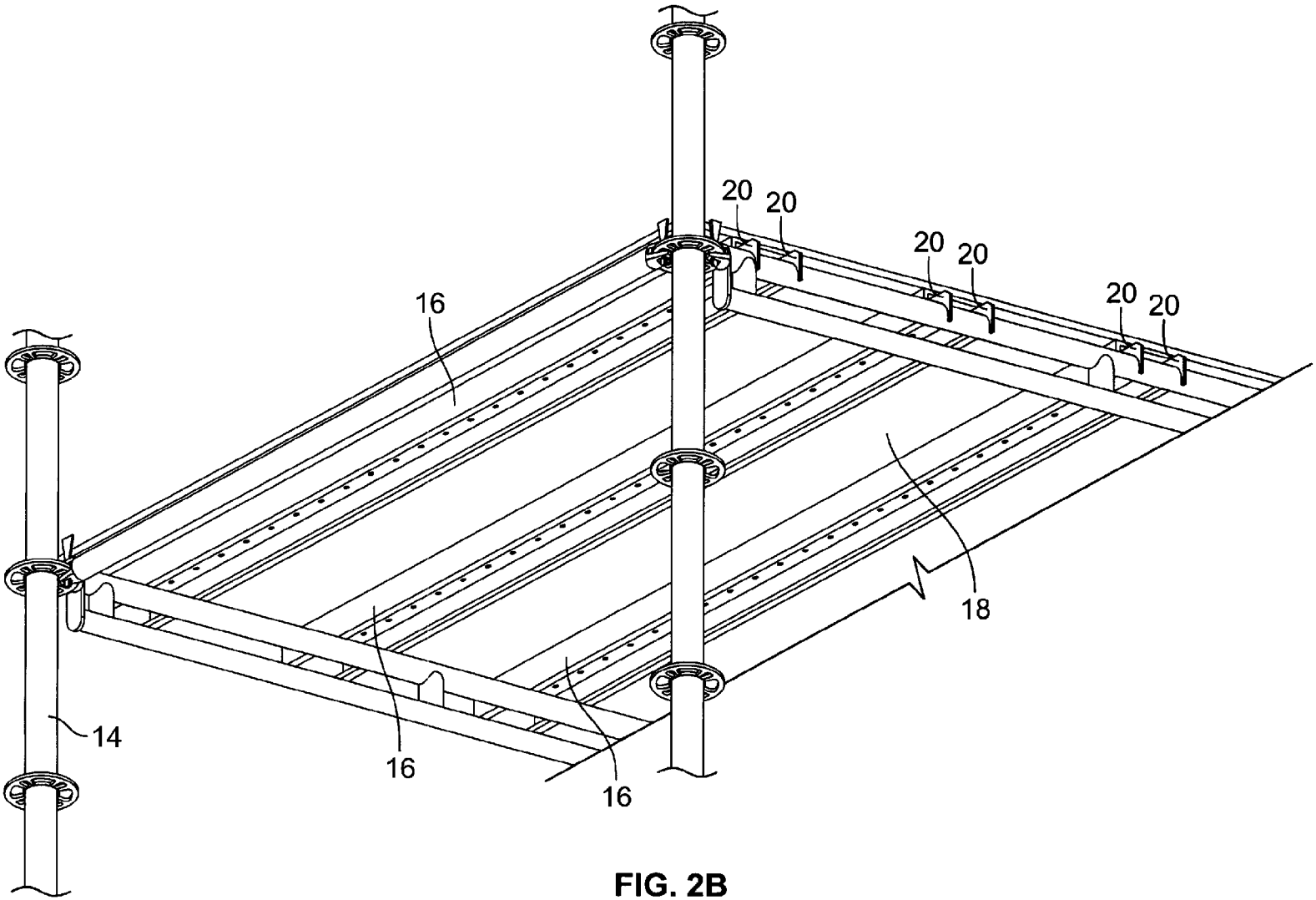
FIG. 2B is a close-up, low-angle view of the floor of the modular scaffold wall system of FIG. 1.
Figure 2C:
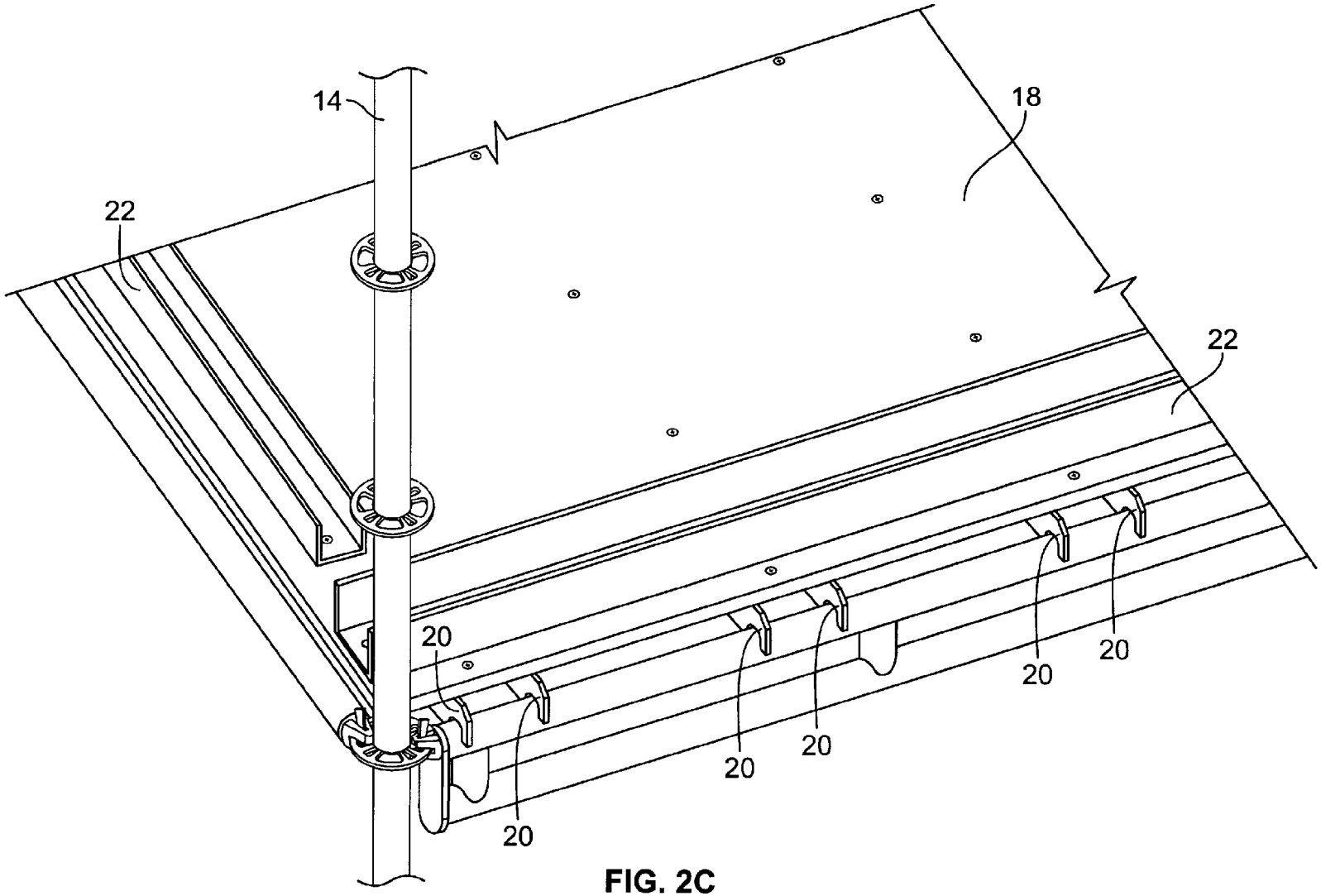
FIG. 2C is a close-up, elevated view of the floor of the modular scaffold wall system of FIG. 1.

FIGS. 2A, 2B, and 2C provide a more detailed view of the floors of the insulated facility 12. FIG. 2A provides a bottom-up view of the floor, and FIG. 2B provides a zoomed-in bottom-up view, to provide a clear view of the support beams 16 and the floor boards 18. The floor of the insulated facility 12 is formed by placing floor support beams 16 across parallel horizontal pipes of the scaffold 14. The ends of the floor support beams 16 are shaped like hooks with semi-circular cutouts. These hooked-ends 20 are shaped to be placed over the horizontal pipes of the scaffold 14. This helps to secure the floor to the scaffold and keep it from shifting or moving. Floor boards 18 are then laid across the floor support beams 16. In a preferred embodiment, both the floor support beams 16 and the floor boards 18 are modular components of standard sizes and shapes. The length of the floor support beams 16 should correspond to the distance between parallel horizontal piping on the scaffold 14. If the design of the scaffolding is consistent from one build to another, standard floor support beams 16 may be pre-fabricated and re-used from one project site to another. Different lengths of floor support beams may be pre-fabricated to correspond to scaffolding designs of different sizes. The floor boards may also be pre-fabricated components of standard size, such as 4'×4' plywood board. This makes manufacture and storage of the parts more cost-effective and efficient. Any remaining gaps left after the floor boards have been laid down can be filled in with smaller boards. The smaller floor boards may also be pre-fabricated in sizes that are commonly needed, such as 1'×4' or 1'×1' boards. The floor boards 18 may be secured to the floor support beams 16 through the use of screws, nails, bolts, or any other appropriate method.

Figure 3A:
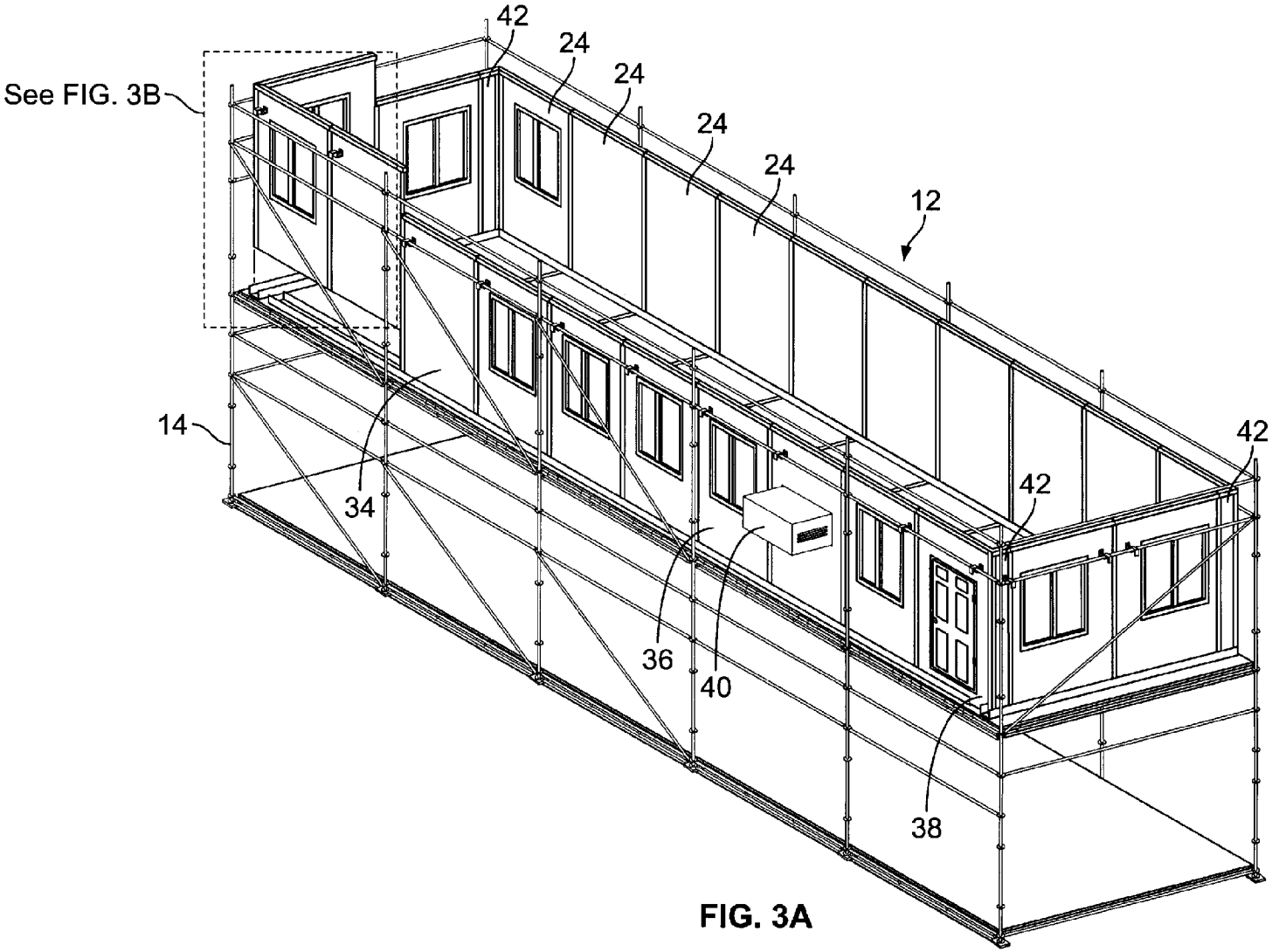
FIG. 3A is an elevated view of the modular scaffold wall system of FIG. 1 with the ceiling removed.
Figure 3B:
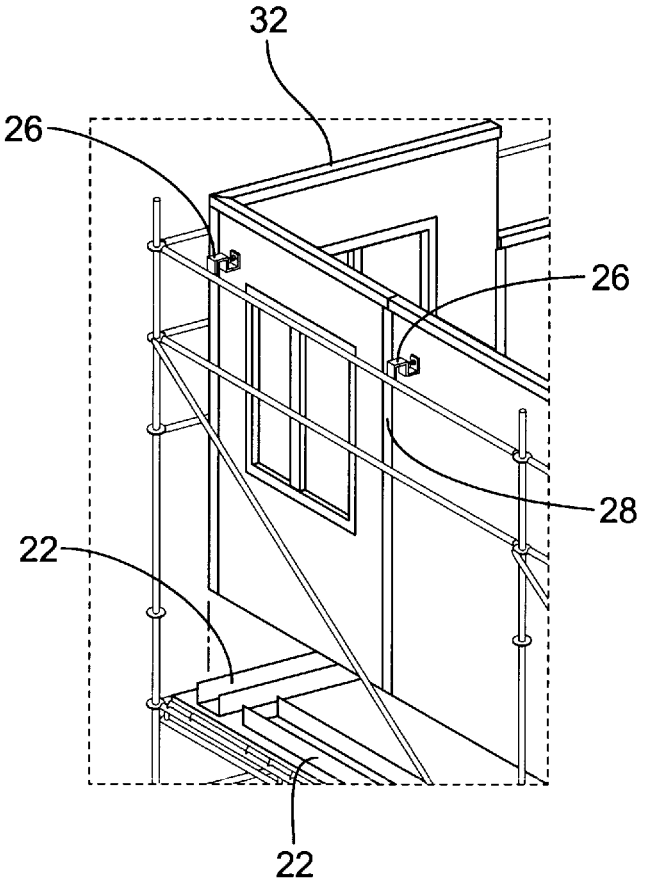
FIG. 3B is a magnified portion of FIG. 3A.

FIG. 2C shows a top-down, close-up view of the floors to provide greater detail of the tops of the floor boards 18. In FIG. 2B, four wall panel tracks 22 are shown around the edges of the floor boards 18. The walls of the insulated facility 12 are formed by sliding wall panels 24 into the wall panel tracks 22. The wall panel tracks 22 are metal tracks that are secured to the floor boards 18. The wall panel tracks 22 may be nailed or screwed to the floor boards 18, or secured by any other appropriate means. These wall panel tracks 22 are rectangular U-shaped tracks having a base, which is secured to the floor boards 18, and two walls, which are spaced apart to receive the wall panels 24. The wall panel tracks 22 are positioned proximate to, and parallel to, the outer edges of the floor boards 18, such that when the wall panels 24 are placed into the tracks 22, four walls are formed around the edges of the floor boards 18. FIG. 3 shows the same view as FIG. 2B with the wall panels having been inserted into the wall tracks 22.

As shown in FIG. 3, the wall panels 24 are inserted into all of the wall panel tracks 22 in such a manner that the insulated facility 12 is substantially enclosed. As was the case with the floor boards 18, modular, standard panels are used for substantially all of the walls. Using modular, standard panels allows for pre-fabrication and reuse of the panels 24, even as structures are torn down and new structures are built. This saves on construction costs, since the panels can be re-used. Additionally, standard, uniform panels are more cost-effective to make and easier to store than customized panels of varying sizes. Various pre-fabricated wall panels are shown in FIG. 3. The wall panels 24 may be offered in a solid panel 34, a window panel 36, a door panel 38, or a panel with air conditioning 40. Any gaps that need to be filled can be filled using smaller wall panels 42. These smaller "gap-filling" panels may also be pre-fabricated in commonly-needed sizes, such as a 1'×8' panel. While other materials may be used, in a preferred embodiment, the wall panels 24 are insulated boards with wood paneling on one side and a galvanized sheet metal on the other. The galvanized sheet metal side faces the outdoors, and provides protection from the elements, while the wood paneling side provides a decorative feel to the interior of the insulated facility 12.

An H-shaped insulating sleeve 28 is placed between each wall panel 24 to close the gaps between each wall panel and provide further insulation for the insulated facility 12. Preferably, the H-shaped sleeves 28 are formed of a semi-flexible material, such as plastic or rubber. They should be shaped and sized such that the gaps between the wall panels 24 are substantially covered, and the sleeves 28 aid in insulating the facility 12 from the outdoors.

As previously described, each panel 24 is partially supported by wall panel tracks 22 that are secured to the floor boards 18. For additional support, each wall panel 24 also has a support hook 26. The support hooks 26 provide additional support for the wall panel 24 by hooking the wall panel to horizontal piping on the scaffold 14. The support hook 26, as shown in the figures, has the shape of two rectangular U-shaped brackets with one of the brackets pointing upward, and one bracket pointing downward. The support hook 26 is positioned on the wall panel 24 at an appropriate height such that the downward facing "U" portion of the support hook hooks onto an adjacent horizontal pipe of the scaffold 14.

Figure 4A:
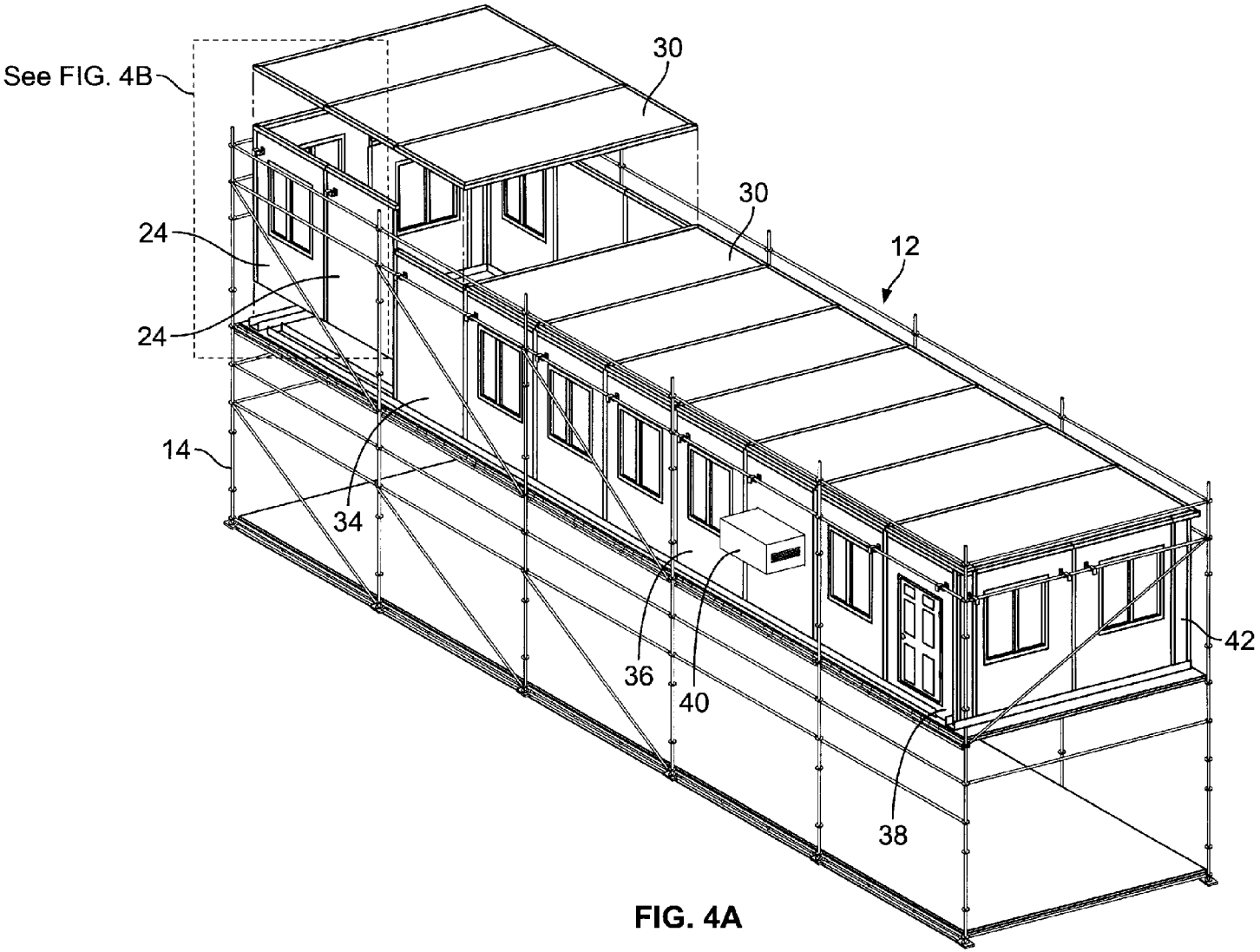
FIG. 4A is an elevated view of the modular scaffold wall system of FIG. 1.
Figure 4B:
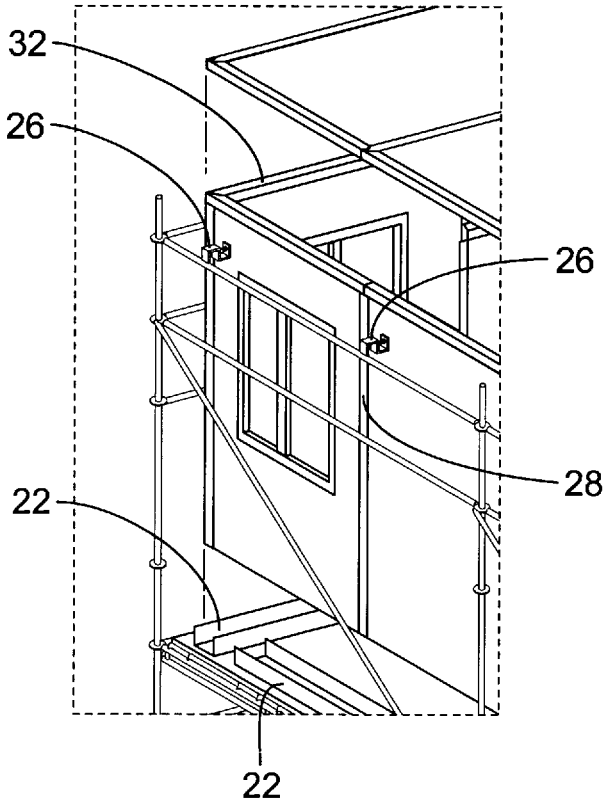
FIG. 4B is a magnified portion of FIG. 4A.

FIG. 4 shows the insulated facility 12 with an assembled ceiling. The ceiling of the insulated facility 12 is formed by laying ceiling panels 30 across the top of the wall panels 24. The ceiling panels 30 may be secured to the wall panels through the use of nails, screws, or any other appropriate means. In the shown embodiment, the ceiling panels 30 are made of similar material to the wall panels 24. The outside wall of the panel is formed of galvanized steel to protect against the elements, while the inner wall is wood paneling or other "interior-appropriate" material. The panel is insulated and the edges are rimmed with a steel channel to give the panel rigidity. As was done with the wall panels 24, H-shaped insulating sleeves 28 are placed between each of the ceiling panels 30 to fill in any gaps between the ceiling panels. An L-shaped track 32 may also be attached to the tops of the wall panels 24 to help prevent shifting of the ceiling panels 30. As was the case with the support beams 16, floor boards 18, and wall panels 24, the ceiling panels 30 may also be pre-fabricated in standard sizes. The length of each ceiling panel preferably corresponds to either the length or the width of the enclosed space so that the ceiling panel rests on top of opposing walls. As such, ceiling panels may be pre-fabricated in sizes corresponding to standard room lengths or widths, e.g., 12'×4' panels or 16'×4' panels.

One advantage of the present invention arises from the fact that sporting events, concerts, political rallies, and many other outdoor event sites already include very large scaffolding structures. The present invention is able to use these existing scaffolding structures to build multiple levels of indoor facilities. By using the existing scaffolding, no additional space is used for the indoor facilities. Additionally, even if new scaffolding structures must be erected specifically for building the present invention, the space footprint is still reduced due to the fact that multiple levels of indoor facilities may be erected.

Another benefit of the present invention is that the presently disclosed system allows for highly customizable indoor spaces. Although modular, standardized components are used, e.g., 4'×8' wall panels, these discrete components can be combined to create a large number of possible layouts. For example, using the same 4'×8' wall panels, a small 4'×4' storage space can be created, or a 20'×60' exhibit hall for hundreds of visitors can be created. Additionally, if standardized components of multiple sizes are used, such as a 1'×8' wall panel, a greater number of size combinations are achievable. By using different combinations of discrete, modular components, an interior space of nearly any shape or size can be created. This represents a significant improvement over the pre-configured mobile office trailers currently available.

Figure 5:
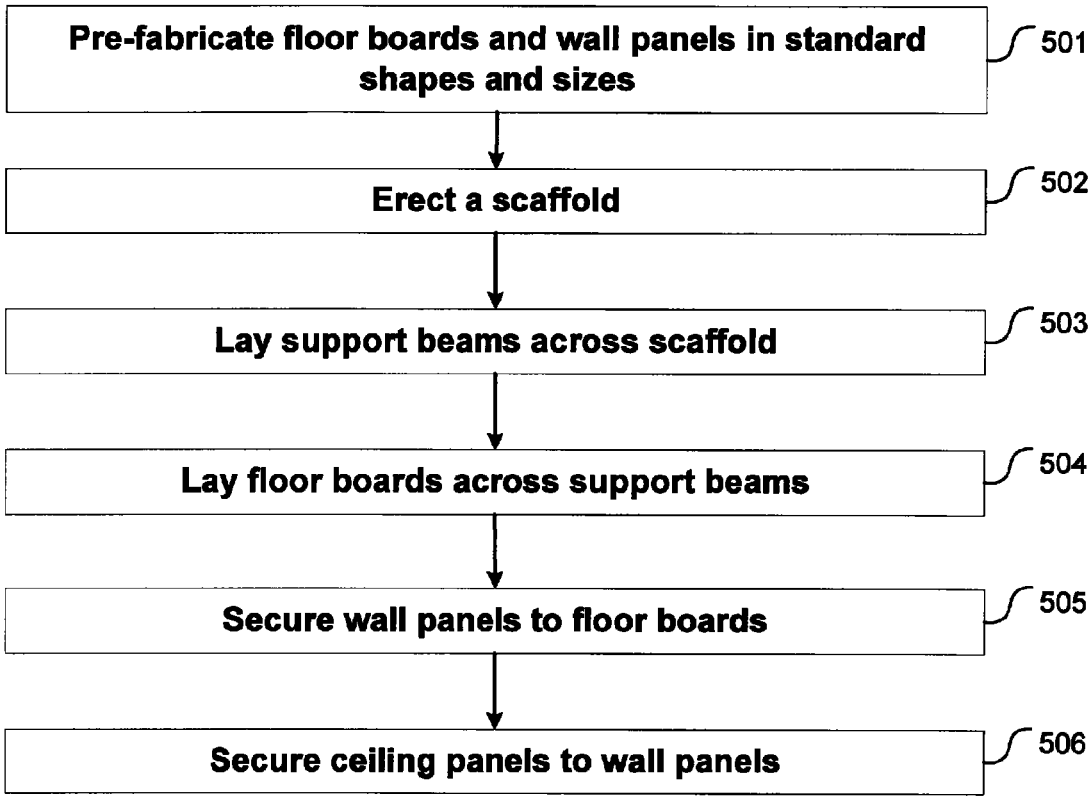
FIG. 5 is a flowchart of a method for constructing a modular temporary structure in accordance with an embodiment of the present invention.

FIG. 5 is a flowchart of a method of constructing a modular temporary structure. In step 501, a plurality of floor boards and wall panels are pre-fabricated in standard shapes and sizes. These standard shapes and sizes may comprise a single standard shape and size, e.g., a 4'×4' floor panel and a 4'×8' wall panel, or the standard shapes and sizes may include multiple standard shapes and sizes. A previously described example included smaller floor boards and wall panels useful for filling in gaps that cannot be filled by the larger wall panels, such as 1'×1' floor panels or 1'×8' wall panels. In step 502, a scaffold is erected. In step 503, a plurality of support beams are laid across the scaffold, and then, in step 504, the plurality of pre-fabricated floor boards are laid across the support beams to create a floor. In step 505, the pre-fabricated wall panels are secured to the floor boards to create a plurality of walls. As stated previously, the plurality of pre-fabricated floor boards and pre-fabricated wall panels may comprise a single standard size and shape of floor boards and wall panels, or may comprise multiple standard sizes and shapes. In step 506, a plurality of ceiling panels are secured to the plurality of walls to create a ceiling.

In a particular embodiment, the support beams and the ceiling panels may also be pre-fabricated in standard shapes and sizes. In the present embodiment, the length of the support beams corresponds to the distance between horizontal beams in the scaffold (so that the hooked ends of the support beams line up with these sets of horizontal beams). Therefore, if the design of the scaffold is standardized such that the distance between sets of horizontal beams is a standard distance, the support beams may be pre-fabricated to match one or more standardized scaffolding sizes. Similarly, in the present embodiment, the length of the ceiling panels corresponds to the length or width of the indoor facility 12. Therefore, the ceiling panels can be pre-fabricated to match one or more standardized room sizes.

Figure 6:
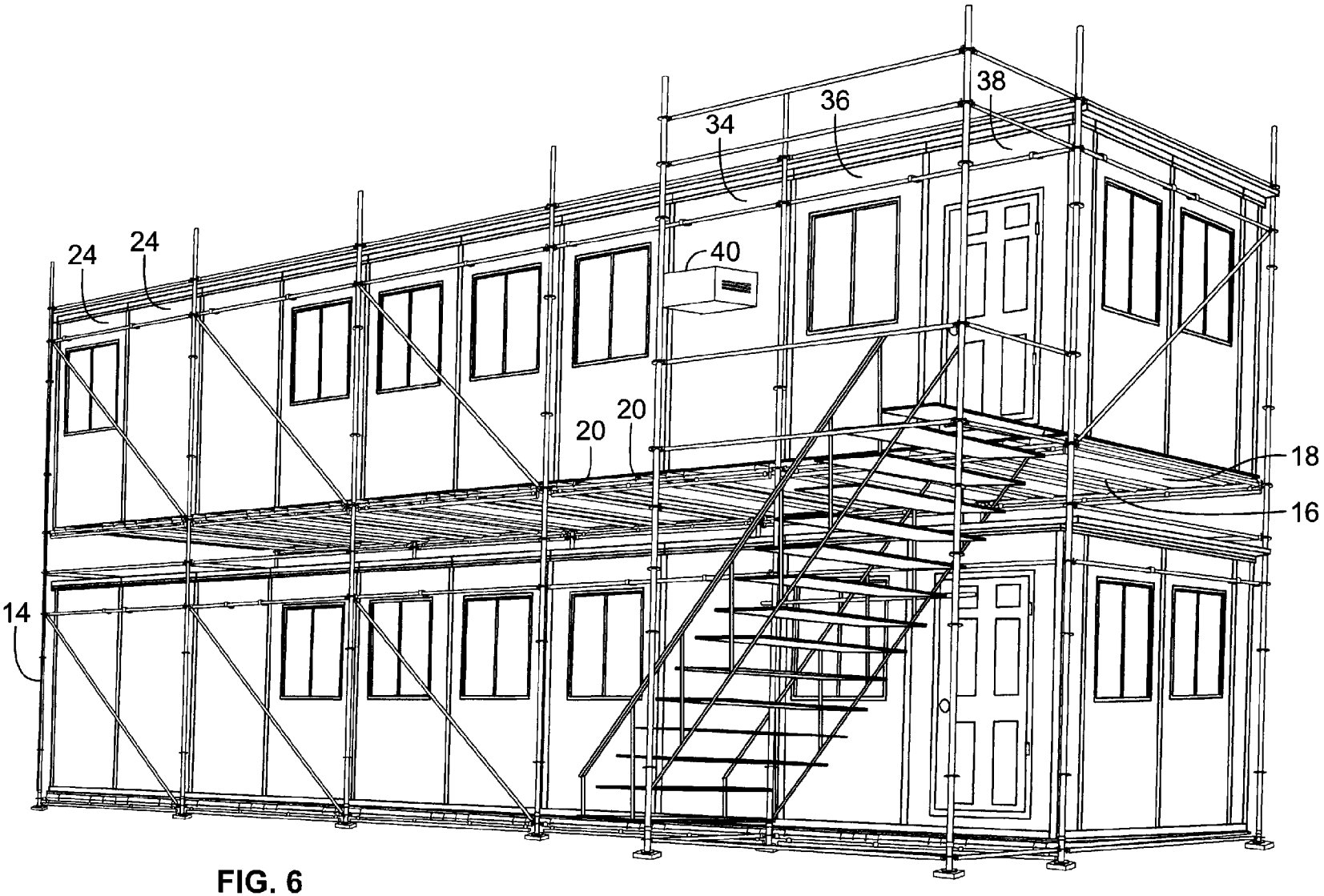
FIG. 6 is a perspective view of a multi-level modular scaffold wall system in accordance with an embodiment of the present invention.

The present invention also allows for building multi-level structures within scaffolding, which allows for better views of the entire site and also reducing the overall footprint of the structure(s) by providing greater indoor square footage while occupying less of the actual site space. FIG. 6 shows a multi-level modular scaffold wall system in accordance with an embodiment of the present invention. The first level has been constructed on the ground level of the scaffold, and a second level has been constructed above the first level. Additional levels may be added above the second level using the same principles as have already been disclosed. A new floor level can be defined at any level of scaffolding that has parallel horizontal piping so that floor support beams 16 can be laid across the scaffold.

Figure 7:
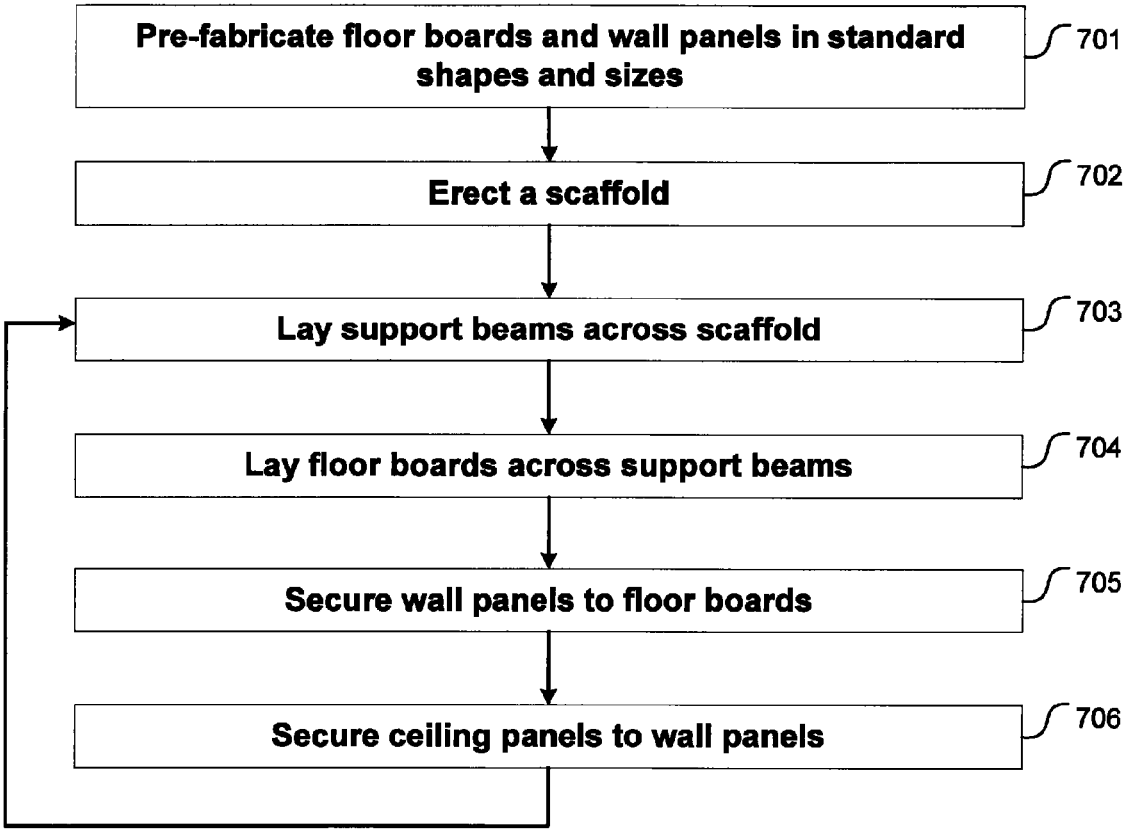
FIG. 7 is a flowchart of a method for constructing the multi-level modular scaffold wall system of FIG. 6.

FIG. 7 is a flowchart of a method of constructing a multi-level modular temporary structure. Much like the method depicted in FIG. 5, this method begins with pre-fabricating a plurality of floor boards and wall panels (step 701) and erecting a scaffold (step 702). Steps 703-706 correspond to steps 503-506 of FIG. 5: support beams are laid across the scaffold (703), floor boards are laid across the support beams to create a floor (704), wall panels are secured to the floor boards to create a plurality of walls (705), and ceiling panels are secured to the plurality of walls to form a ceiling (706). Then, steps 703-706 are repeated at a different level of the scaffold in order to create a multi-level structure. The present invention allows for a new level to be defined at any level of scaffolding that has parallel horizontal piping. As such, the structure can contain as many levels as the scaffold design will support, an advantage that was previously unavailable with the use of mobile trailer offices.

Although the invention has been disclosed with reference only to the presently preferred embodiments, those of ordinary skill in the art will appreciate that various modifications can be made without departing from the invention. Accordingly, the invention is defined only by the following claims.

What is claimed is:

1. A temporary structure comprising:

a scaffold;

a floor that is supported by the scaffold;

a plurality of walls supported by the floor; and a ceiling directly supported by the plurality of walls;

wherein the floor, the plurality of walls, and the ceiling define a substantially enclosed space;

wherein the plurality of walls comprises a plurality of wall panels; and wherein the wall panels in the plurality of wall panels are positioned adjacent to one another such that the wall panels are uninterrupted by the scaffold and are located entirely within the scaffold.

2. The structure of claim 1, wherein the floor comprises:

a plurality of floor support beams supported by the scaffold; and a plurality of floor boards supported by the floor support beams.

3. The structure of claim 2, wherein the floor comprises pre-fabricated floor panels.

4. The structure of claim 1, wherein the wall panels are insulated panels.

5. The structure of claim 4, further comprising a plurality of insulative sleeves placed between each of the wall panels.

6. The structure of claim 1, wherein the wall panels are further supported by the scaffold through support hooks that hook the wall panels onto the scaffold.

7. The structure of claim 1, further comprising a plurality of tracks secured to the floor for receiving the wall panels.

8. A modular temporary structure comprising:

a scaffold;

a plurality of support beams laid across the scaffold;

a plurality of floor panels laid on the plurality of support beams to form a floor;

a plurality of wall panel tracks secured to the floor;

a plurality of wall panels inserted into the plurality of wall panel tracks to substantially enclose the floor, forming a plurality of walls;

and a plurality of ceiling panels laid directly on top of the plurality of walls to form a ceiling;

wherein the floor, the plurality of walls, and the ceiling define a substantially enclosed space; and wherein the wall panels in the plurality of wall panels are positioned adjacent to one another such that the wall panels are uninterrupted by the scaffold and are located entirely within the scaffold.

9. The modular temporary structure of claim 8, wherein the wall panels are insulated wall panels.

10. The modular temporary structure of claim 8, further comprising a plurality of insulative sleeves placed between each of the wall panels.

11. The modular temporary structure of claim 8, wherein each of the plurality of wall panels has a support hook for securing each wall panel to the scaffold.

12. A method of constructing a modular temporary structure comprising:

pre-fabricating a plurality of floor boards and wall panels;

erecting a scaffold;

laying a plurality of support beams across the scaffold;

laying the plurality of pre-fabricated floor boards across the support beams to create a floor;

securing the plurality of pre-fabricated wall panels to the floor boards to create a plurality of walls;

and securing a plurality of ceiling panels directly to the plurality of walls to create a ceiling;

wherein the floor, the plurality of walls, and the ceiling define a substantially enclosed space; and wherein the step of securing the plurality of pre-fabricated wall panels to the floor boards comprises positioning the pre-fabricated wall panels adjacent to one another such that the pre-fabricated wall panels are uninterrupted by the scaffold and are located entirely within the scaffold.

13. The method of claim 12, wherein the step of securing the plurality of pre-fabricated wall panels to the floor boards also comprises securing the pre-fabricated wall panels to the scaffold.

14. A method of constructing a multi-level modular temporary structure comprising:

pre-fabricating a plurality of floor boards and wall panels;

erecting a scaffold; and performing the following steps (a)-(d) on both a first level of the scaffold and a second level of the scaffold:

(a) laying a plurality of support beams across the scaffold, (b) laying the plurality of pre-fabricated floor boards across the support beams to create a floor, (c) securing the plurality of pre-fabricated wall panels to the floor boards to create a plurality of walls, and (d) securing a plurality of ceiling panels directly to the plurality of walls to create a ceiling, wherein the floor, the plurality of walls, and the ceiling define a substantially enclosed space; and wherein the step of securing the plurality of pre-fabricated wall panels to the floor boards comprises positioning the pre-fabricated wall panels adjacent to one another such that the pre-fabricated wall panels are uninterrupted by the scaffold and are located entirely within the scaffold.

15. The method of claim 14, wherein the step of securing the plurality of pre-fabricated wall panels to the floor boards also comprises securing the pre-fabricated wall panels to the scaffold.

16. A temporary structure comprising:

a scaffold;

a floor that is supported by the scaffold;

a plurality of walls supported by the floor;

and a ceiling directly supported by the plurality of walls;

wherein the floor, the plurality of walls, and the ceiling define a substantially enclosed space;

wherein the plurality of walls comprises a plurality of wall panels located entirely within the scaffold;

wherein the wall panels are insulated panel; and wherein a plurality of insulative sleeves are placed between each of the wall panels.

17. A modular temporary structure comprising:

a scaffold;

a plurality of support beams laid across the scaffold;

a plurality of floor panels laid on the plurality of support beams to form a floor;

a plurality of wall panel tracks secured to the floor;

a plurality of wall panels inserted into the plurality of wall panel tracks to substantially enclose the floor, forming a plurality of walls located entirely within the scaffold;

a plurality of insulative sleeves placed between each of the wall panels; and a plurality of ceiling panels laid directly on top of the plurality of walls to form a ceiling;

wherein the floor, the plurality of walls, and the ceiling define a substantially enclosed space.

18. The structure of claim 6, wherein each of the support hooks is shaped such that a first bracket portion of the support hook has a first opening in a first direction, and a second bracket portion of the support hook has a second opening in an opposite direction.

19. The modular temporary structure of claim 11, wherein a first bracket portion of the support hook has a first opening in a first direction, and a second bracket portion of the support hook has a second opening in an opposite direction.

20. The temporary structure of claim 16, further comprising a plurality of support hooks for securing the plurality of walls to the scaffold, wherein each of the plurality of support hooks is shaped such that a first bracket portion of the support hook has a first opening in a first direction, and a second bracket portion of the support hook has a second opening in an opposite direction.

21. The modular temporary structure of claim 17, further comprising a plurality of support hooks for securing the plurality of walls panels to the scaffold, wherein each of the plurality of support hooks is shaped such that a first bracket portion of the support hook has a first opening in a first direction, and a second bracket portion of the support hook has a second opening in an opposite direction.

* * * * *